US008985759B2

(12) United States Patent
Hombo

(10) Patent No.: US 8,985,759 B2
(45) Date of Patent: Mar. 24, 2015

(54) IMAGE FORMING APPARATUS

(75) Inventor: Tsunao Hombo, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 1073 days.

(21) Appl. No.: 12/968,234

(22) Filed: Dec. 14, 2010

(65) Prior Publication Data

US 2011/0142479 A1 Jun. 16, 2011

(30) Foreign Application Priority Data

Dec. 16, 2009 (JP) ..... 2009-285751

(51) Int. Cl.
*G03G 15/00* (2006.01)

(52) U.S. Cl.
CPC ..... *G03G 15/5004* (2013.01); *G03G 15/80* (2013.01); *G03G 2215/00556* (2013.01)
USPC ..... 347/104

(58) Field of Classification Search
USPC ..... 307/9.1, 1–4; 399/88
See application file for complete search history.

(56) References Cited

U.S. PATENT DOCUMENTS 7,277,651 B2 * 10/2007 Hanamoto et al. ..... 399/69
7,889,061 B2 * 2/2011 Endo ..... 340/12.33
8,225,117 B2 * 7/2012 Hanada et al. ..... 713/310
2003/0230568 A1 * 12/2003 Yamanaka ..... 219/665
2006/0077046 A1 4/2006 Endo
2006/0206735 A1 * 9/2006 Nagafusa ..... 713/300
2008/0019709 A1 * 1/2008 Eom ..... 399/9
2009/0091182 A1 * 4/2009 Tamada et al. ..... 307/2

FOREIGN PATENT DOCUMENTS

JP 2007-110354 A 4/2007
JP 2008-244701 A 10/2008
JP 2009-135560 A 6/2009

* cited by examiner

*Primary Examiner* — Rexford Barnie
*Assistant Examiner* — Daniel Kessie
(74) *Attorney, Agent, or Firm* — Canon U.S.A., Inc. IP Division

(57) ABSTRACT

An image forming apparatus includes a first power source configured to supply power for driving a load to be used for image formation via a first power line, a load control circuit configured to control driving of the load, a control circuit configured to output control data for the load control circuit to control the load, a second power source configured to supply power for the load control circuit via a second power line provided separately from the first power line, a superimposing circuit configured to superimpose the control data output from the control circuit onto the second power line, and a separation circuit configured to separate the control data from the second power line, on which the control data is superimposed and sent, and to output the control data to the load control circuit.

5 Claims, 6 Drawing Sheets

IMAGE FORMING APPARATUS

BACKGROUND OF THE INVENTION

1. Field of the Invention

The present invention relates to a power line communication in an image forming apparatus.

2. Description of the Related Art

In conventional image forming apparatuses, a method of greatly reducing the number of signal lines used for communication and control signal lines by performing data transfer by way of serial communication is implemented in a unit (circuit board) that does not require high data transfer speed. However, a large number of signal lines are provided between the circuit boards in the image forming apparatus as a whole. Further, many power lines are provided for power supply to the circuit boards in addition to the communication and control signal lines. The communication and control signal lines and the power lines occupy a large part of a space in the image forming apparatus.

U.S. Patent Application Publication No. 2006/0077046 discusses that, to further reduce the number of communication and signal lines, the number of communication and control signal line bundles is reduced by using a power line as a signal transmission path and performing the communication between a plurality of circuit boards connected to the power line and a control module.

In the case of performing signal transmission by using a power line, it is desirable that a transmission path is electrically stable for enabling stable communication. However, in image forming apparatuses, a current supplied from a direct current power source is sometimes changed to a large degree depending on an operational status of a load during an image forming operation. Particularly, a current power source assigned to a driving unit such as a motor and an actuator is greatly fluctuated depending on an operation state. Since impedance in the transmission path is also greatly fluctuated in such a power line, it is sometimes difficult to perform the stable communication depending on the operation status of the image forming apparatus.

SUMMARY OF THE INVENTION

The present invention is directed to an image forming apparatus capable of performing stable power line communication that is suppressed in transmission error.

According to an aspect of the present invention, an image forming apparatus includes a first power source configured to supply power for driving a load to be used for image formation via a first power line, a load control circuit configured to control driving of the load, a control circuit configured to output control data for the load control circuit to control the load, a second power source configured to supply power for the load control circuit via a second power line provided separately from the first power line, a superimposing circuit configured to superimpose the control data output from the control circuit onto the second power line, and a separation circuit configured to separate the control data from the second power line, on which the control data is superimposed and sent, and to output the control data to the load control circuit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
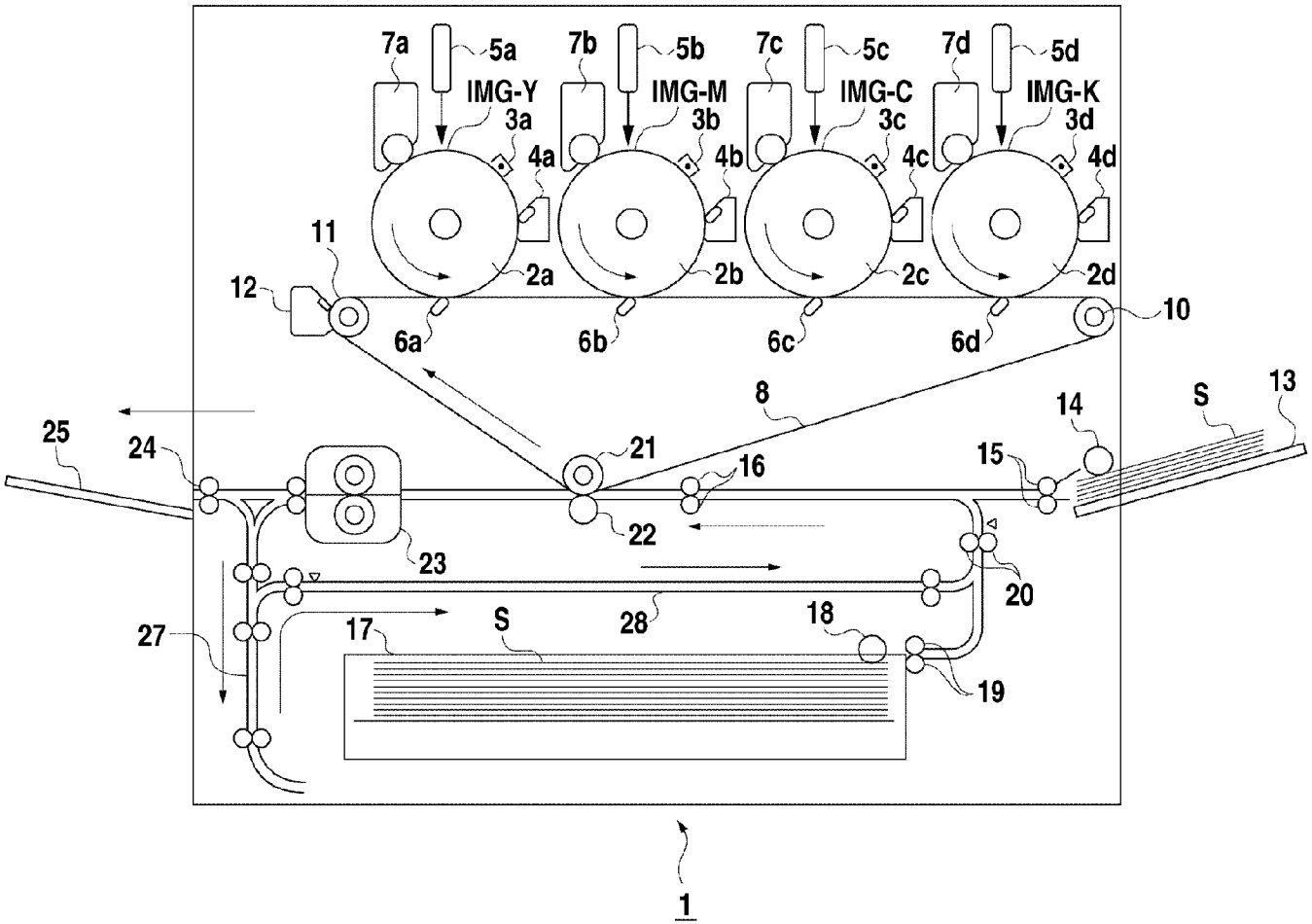
FIG. 1 is a sectional view illustrating an image forming apparatus according to a first exemplary embodiment of the present invention.

FIG. 1 is a sectional view illustrating an entire configuration of an image forming apparatus according to a first exemplary embodiment of the present invention. The image forming apparatus 1 is a full-color printer that forms an image on a recording sheet by employing electrophotography. The image forming apparatus 1 is provided with photosensitive drums 2*a* to 2*d* for four colors, charging devices 3*a* to 3*d*, cleaners 4*a* to 4*d*, laser scanning units 5*a* to 5*d*, transfer blades 6*a* to 6*d*, developing units 7*a* to 7*d*, an intermediate transfer belt 8, and a cleaner 12. The image forming apparatus 1 is further provided with a steering roller 10 supporting the intermediate belt 8 and a belt driving roller 11 for rotating the intermediate transfer belt 8 in a predetermined direction.

A plurality of recording sheets S set in a manual feed tray 13 are separated to be fed one by one by a pickup roller 14 and separation rollers 15. The plurality of recording sheets S housed in a sheet feeding cassette 17 are separated to be fed one by one by a pickup roller 18 and separation rollers 19 and conveyed by feeding rollers 20.

The thus-fed recording sheet S is conveyed to a second transfer roller 22 with timing being adjusted by registration rollers 16. Here, each of the rollers 14, 15, 16, 18, 19, and 20 for conveying the recording sheet S is driven by an independent stepping motor for realizing a high speed and stable conveyance operation.

The charging devices 3*a* to 3*d* uniformly charge surfaces of the photosensitive drums 2*a* to 2*d*. The laser scanning units 5*a* to 5*d*, of which light sources are semiconductor lasers, irradiate the photosensitive drums 2*a* to 2*d* with laser beams to form electrostatic latent images on the photosensitive drums 2*a* to 2*d*. The developing units 7*a* to 7*d* develop the electrostatic images as toner images.

The transfer blades 6*a* to 6*d* transfer the toner images of four colors developed on the photosensitive drums 2*a* to 2*d* onto the intermediate transfer belt 8. The toner image on the intermediate transfer belt 8 is transferred onto the recording sheet S at a nip portion of a rotation roller 21 and the second transfer roller 22. A fixing device 23 having heating rollers applies heat to the toner image transferred onto the recording sheet S, so that the toner image is fixed onto the recording sheet.

In the case of two-sided printing, the recording sheet S that has passed the fixing device 23 is directed to a direction of a two-sided-reserving path 27 and conveyed in a reverse direction, so that the first side and the second side of the sheet S are reversed when the sheet S is conveyed to a two-sided printing path 28. The recording sheet S that has passed the two-sided printing path 28 is conveyed to the feeding rollers 20 again, and an image for the second side is formed in the same manner as in the first side. After that, the recording sheet S is discharged by discharge rollers 24 to a sheet discharge tray 25.

Figure 2:
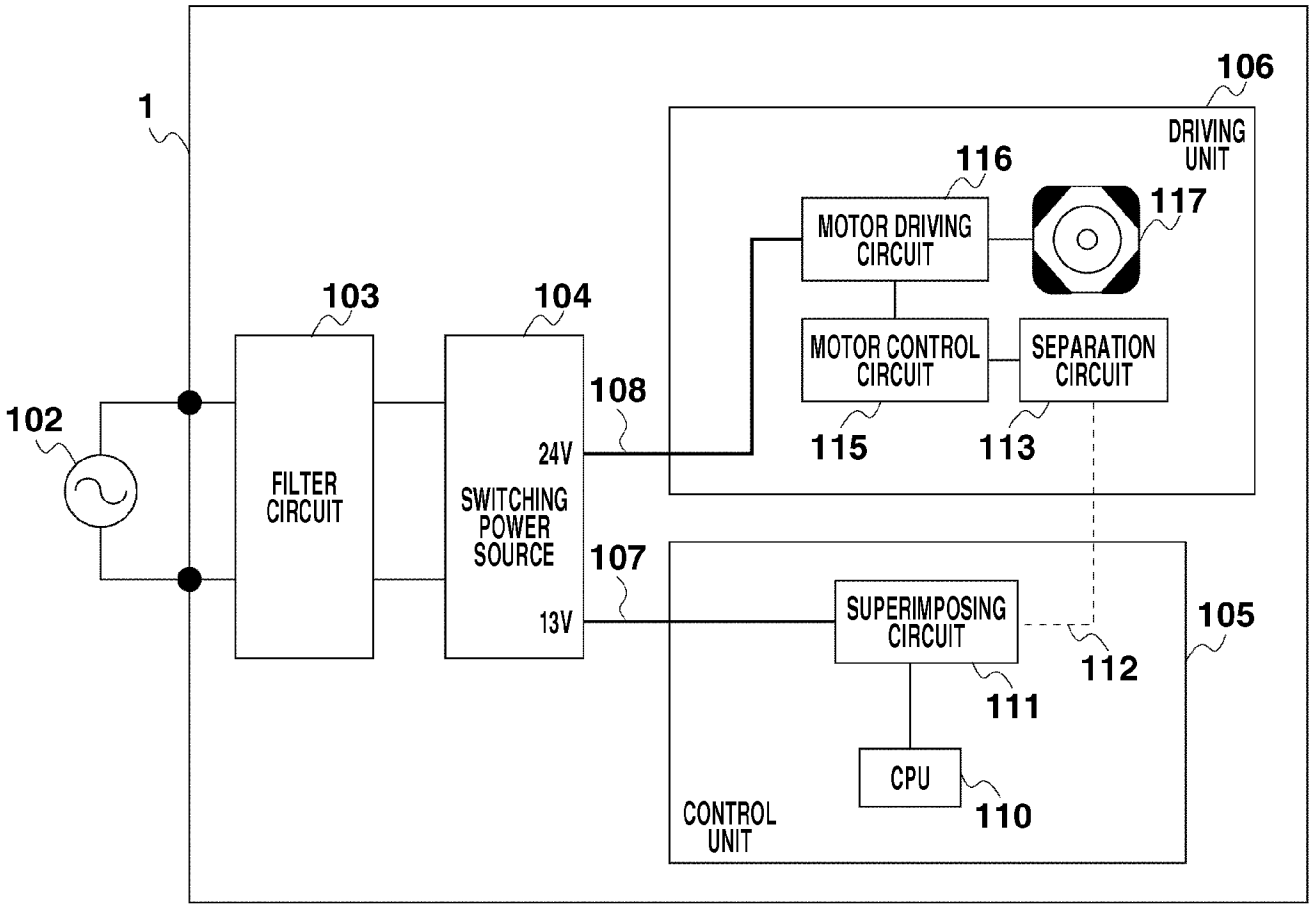
FIG. 2 is a block diagram illustrating configurations of a power source and control units of the image forming apparatus according to the first exemplary embodiment.

FIG. 2 is a block diagram illustrating configurations of a power source and control units of the image forming apparatus 1. Alternating current power from a commercial power source 102 is input into a switching power source 104 via a filter circuit 103. The switching power source 104 outputs a constant voltage of 13 V from a power line 107 and outputs a constant voltage of 24 V from a power line 108. The outputs from the switching power source 104 are supplied to a plurality of circuit boards (units) in the image forming apparatus 1. In the present exemplary embodiment, the constant voltage of 13 V is supplied to a control unit 105 via the power line 107 serving as a second power line, and the constant voltage 24 V is supplied to a driving unit 106 via the power line 108 serving as a first power line. The second power line outputs 13 V but may output 5 V depending on a type of an element to which the power is supplied. Also, the switching power source 104 outputs the two types of constant voltages in the above-described configuration, but a first power source for outputting 24 V and a second power source for outputting 13 V may be provided.

The control unit 105 includes a central processing unit (CPU) 110 for controlling operations of the image forming apparatus 1 and a superimposing circuit 111 for superimposing communication data onto the power line 107 and outputting the communication data. The driving unit 106 includes a pulse motor 117, a motor driving circuit 116 for driving the pulse motor 117, a motor control circuit 115 for controlling the motor driving circuit 116, and a separation circuit 113. The separation circuit 113 has functions of inputting power from a power line 112 on which motor control data are superimposed from the control unit 105 and separating the motor control data and the power for the separation circuit 113 from each other. The constant voltage of 24 V dedicated to motor driving is connected to the motor driving circuit 116 from the switching power source 104 via the power line 108, so that the constant voltage of 24 V is supplied as driving power for the pulse motor 117. The pulse motor 117 is equivalent to a motor for driving the pickup rollers 14 and 18 of the image forming apparatus 1 illustrated in FIG. 1 and frequently turned on and off during an image forming operation. The pulse motor 117 may be a motor for driving the registration rollers 16 or other feed rollers.

Though it is not illustrated, the constant voltage 13 V input into the control unit 105 is input into the superimposing circuit 111. The superimposing circuit 111 superimposes the motor control data from the CPU 110 onto the power line 112, so that the motor control data is supplied to the driving unit 106 together with the power. The separation circuit 113 separates the motor control data and the power supplied via the power line 112 from each other. Though it is not illustrated, the constant voltage 13 V input into the control unit 105 is input into a power source circuit not illustrated and converted into a plurality of different voltages to be supplied to the CPU 110 and the superimposing circuit 111 in the control unit 105, the separation circuit 113 in the driving unit 106, the motor control circuit 115, and the like.

Figure 3:
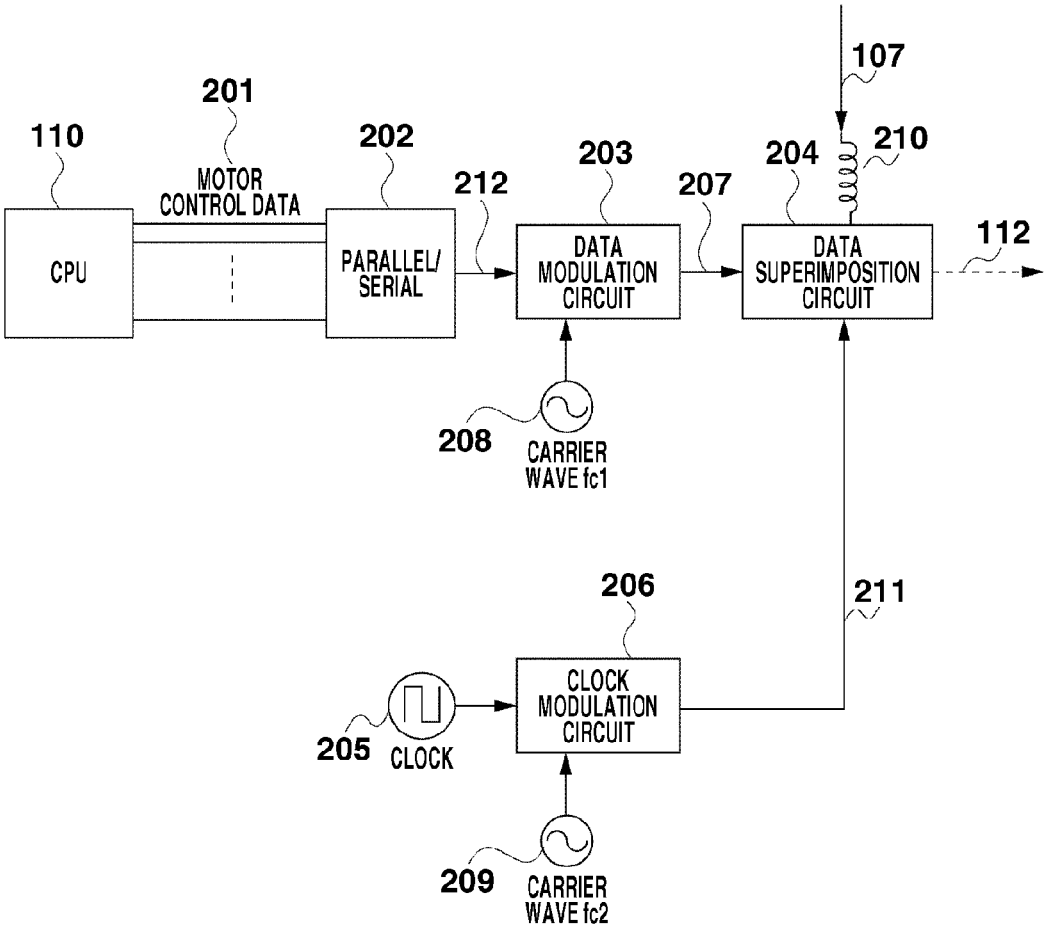
FIG. 3 is a diagram illustrating a configuration of a superimposing circuit.

Hereinafter, the superimposition circuit 111 will be described. FIG. 3 is a block diagram illustrating a configuration of the superimposing circuit 111. Here, motor control data including parallel signals and a reference clock for motor driving are superimposed onto the direct current power.

Parallel motor control data 201 generated by the CPU 110 is converted into serial data 212 by a parallel/serial conversion circuit 202 to be input into a data modulation circuit 203. The serial data 212 is converted into modulated data 207 having a carrier wave of a frequency fc1 by the data modulation circuit 203. A reference clock 205 for driving the pulse motor 117 is converted into modulated data 211 having a carrier wave of a frequency fc2 by a clock modulation circuit 206 in the same manner.

The modulated data 207 and 211 are superimposed onto the constant voltage 13 V by a data superimposing circuit 204 via an inductor 210 to be output via the power line 112. The inductor 210 has impedance that is satisfactorily high for the modulated data 207 and 211 and prevents the modulated data from leaking to the power line 107.

Figure 5:
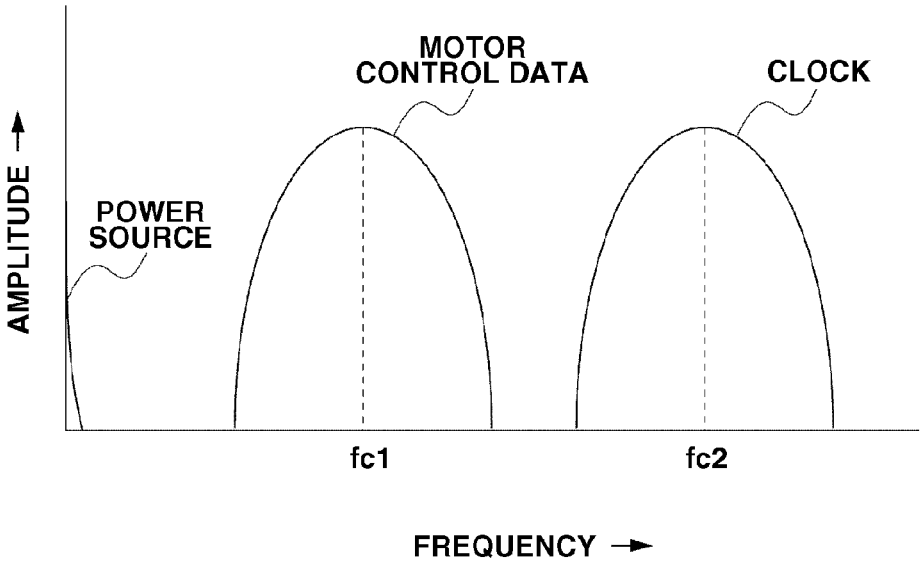
FIG. 5 is a diagram illustrating a relationship between frequencies of data sent by a power line.

FIG. 5 is a diagram illustrating a relationship between the frequencies of the data contained in the power line 112. In the present exemplary embodiment, the modulation frequency fc2 of the motor reference clock 205 is set higher than the modulation frequency fc1 of the motor control data 201, but an inverted relationship does not cause any issue.

In the case of sending the motor control data by using a power line, the use of the power line 108 to the motor driving circuit 116 may be considered. However, since the pulse motor 117 is frequently turned on and off during an image forming operation, it is highly possible that a power fluctuation is caused at the moment of turning on or off. Accordingly, the data sent by the power source can be inaccurate. The same applies to the power line for a driving circuit for an actuator not illustrated, other than the power line for a motor. Therefore, in the present exemplary embodiment, accurate data transmission is realized by performing a power line communication by using the power line to the control unit 105 that is suppressed in load fluctuation, not the power line for the driving circuit for operating a movable member such as the motor and the actuator.

Figure 4:
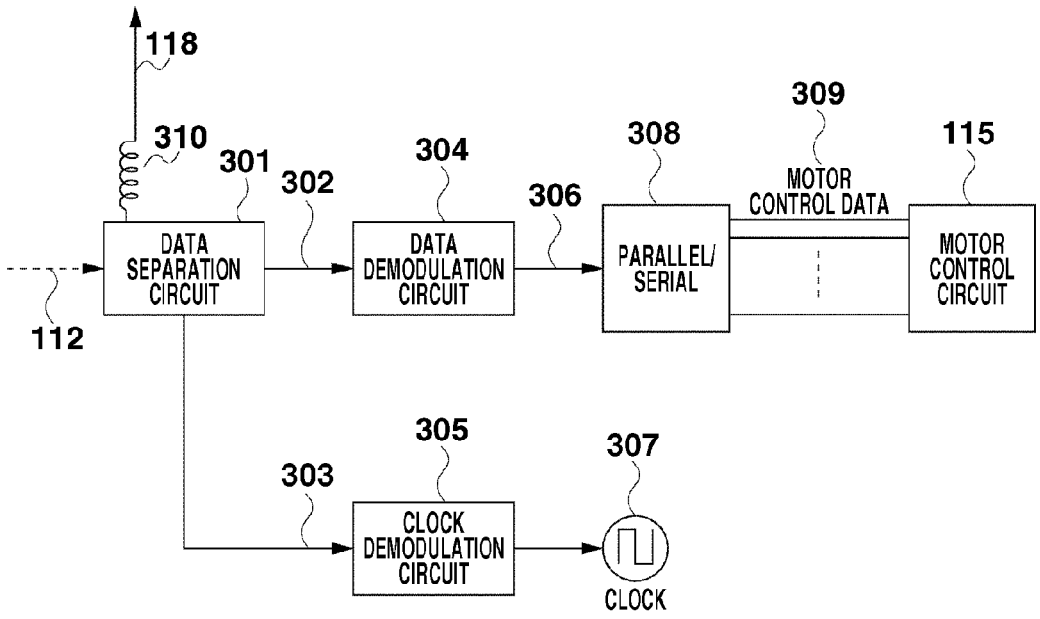
FIG. 4 is a diagram illustrating a configuration of a separation circuit.

Hereinafter, the separation circuit 113 will be described. FIG. 4 is a block diagram illustrating functions of the separation circuit 113. The power onto which modulated motor control data and the modulated reference clock are superimposed via the power line 112 is separated by a data separation circuit 301 into power 118, motor control data 302 modulated with the frequency fc1, and a reference clock 303 modulated with the frequency fc2. An inductor 310 prevents the modulated data from leaking to the power 118.

The motor control data 302 is converted into serial digital data 306 by a data demodulation circuit 304 to be converted into motor control data of parallel system via a serial/parallel conversion circuit 308. The reference clock 303 is converted into a clock 307 by a clock demodulation circuit 305 to be input into the motor control circuit 115 together with the motor control data 302.

In the present exemplary embodiment, the power line for driving, which is subject to the large load fluctuation, is not used as the communication line, and the power line for the control unit which is suppressed in load fluctuation is used. However, other power lines may be used insofar as the power line is suppressed in voltage fluctuation.

A voltage value other than a direct current voltage value generated by a switching power source is sometimes required depending on a unit in the image forming apparatus. In such case, a direct current/direct current (DC/DC) convertor is provided for the purpose of generating a necessary voltage value. It is possible to attain the same effect by superimposing control data onto an output of the DC/DC converter.

Figure 6:
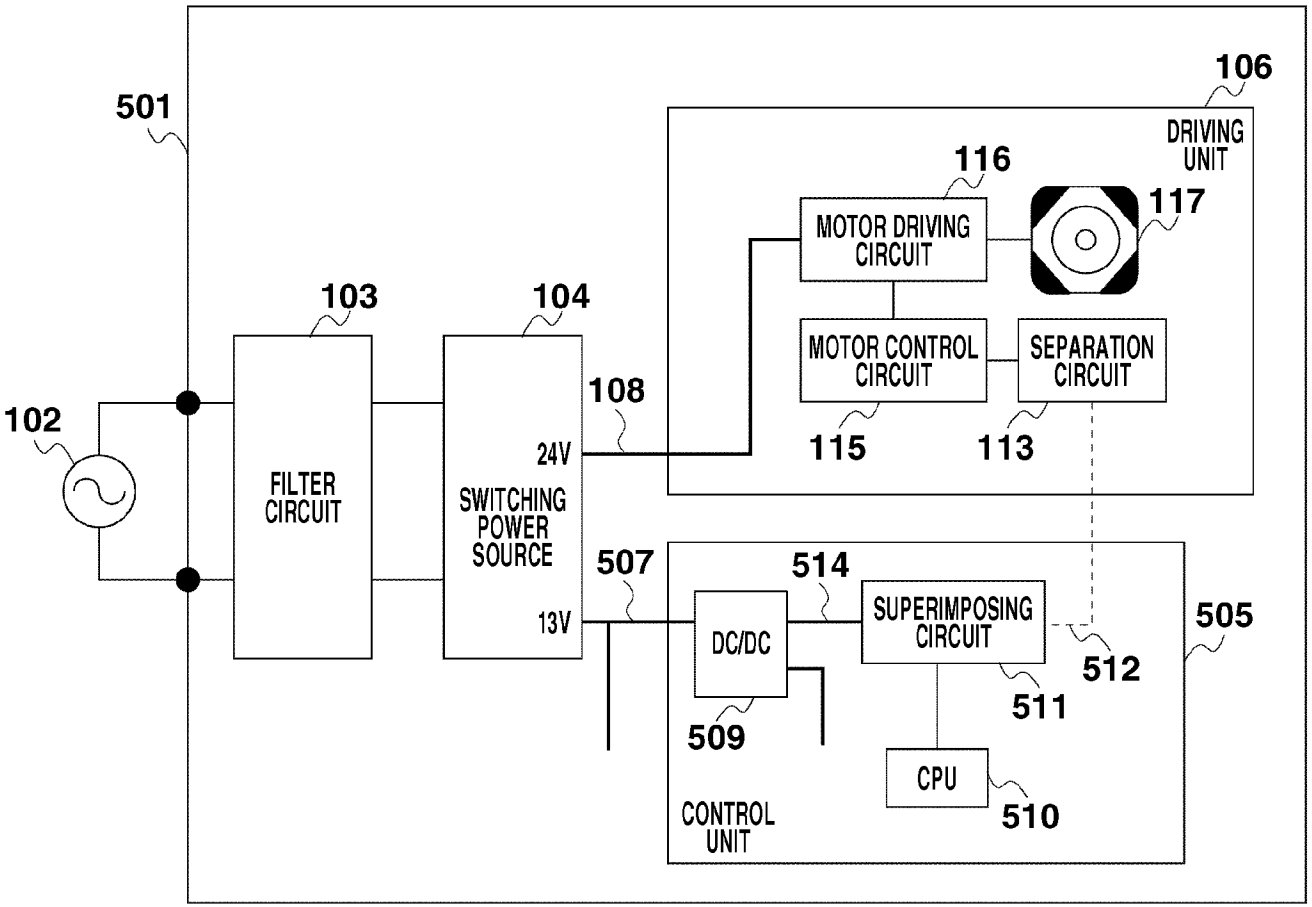
FIG. 6 is a block diagram illustrating configurations of a power source and control units of an image forming apparatus according to a second exemplary embodiment of the present invention.

FIG. 6 is a block diagram illustrating configurations of a power source and control units of an image forming apparatus 501 according to a second exemplary embodiment of the present invention. A predetermined constant voltage is supplied from a switching power source 104 to a DC/DC convertor 509 inside a control unit 505 via a power line 507 to be converted into another constant voltage. The converted constant voltage is supplied to a superimposing circuit 511 via a power line 514. The superimposing circuit 511 superimposes control data from a CPU 510 onto the supplied constant voltage to supply the data and voltage to a separation circuit 113 of a driving unit 106 via a power line 512. Since other parts of the configuration are the same as those of the first exemplary embodiment, descriptions thereof are not repeated. As another configuration, the other parts may, for example, be similar to those of the first exemplary embodiment without departing from the scope of the present invention.

As described above, it is possible to reduce the number of bundles of signal lines and to perform stable communication by performing signal communication via the power line having the small load fluctuation.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-285751 filed Dec. 16, 2009, which is hereby incorporated by reference herein in its entirety.

What is claimed is:

1. An image forming apparatus comprising:

a first power source configured to supply power for driving a load to be used for image formation via a first power line;

a load control circuit configured to control driving of the load;

a control circuit configured to output control data for the load control circuit to control the load;

a second power source configured to supply power for a part of the control circuit and a part of the load control circuit via a second power line provided separately from the first power line;

a superimposing circuit, provided as the part of the control circuit, configured to superimpose the control data output from the control circuit onto the second power line; and a separation circuit, provided as the part of the load control circuit, configured to separate the control data from the second power line, which is sent with the control data being superimposed thereonto, and to output the control data to the load control circuit, wherein the first power line is not used for sending the control data for the load control circuit.

2. The image forming apparatus according to claim 1, wherein the load includes a motor configured to repeat a driving state and a stop state during an image forming operation.

3. The image forming apparatus according to claim 2, wherein the motor is configured to feed a sheet on which an image is formed.

4. The image forming apparatus according to claim 2, further comprising a clock generation circuit configured to generate a clock signal for driving the motor, wherein the superimposing circuit superimposes the clock signal generated by the clock generation circuit onto the second power line, and wherein the separation circuit separates the clock signal from the second power line.

5. The image forming apparatus according to claim 1, wherein the second power source supplies power to the part of the control circuit via the second power line.

* * * * *